United States Patent [19]

Lautenschläger

[11] Patent Number: 4,738,445

[45] Date of Patent: Apr. 19, 1988

[54] ERGOMETER

[75] Inventor: Peter Lautenschläger, Gonbach, Fed. Rep. of Germany

[73] Assignee: Keiper Dynavit GmbH & Co. KG, Fed. Rep. of Germany

[21] Appl. No.: 802,380

[22] Filed: Nov. 27, 1985

[30] Foreign Application Priority Data

Nov. 27, 1984 [DE] Fed. Rep. of Germany ..... 3443126

[51] Int. Cl.[4] ..... A63B 21/00; A63B 23/04

[52] U.S. Cl. ..... 272/73; 272/DIG. 6; 272/134

[58] Field of Search ..... 272/73, 71, DIG. 6, 272/134, 143; 128/25 R, 70; 269/322–324, 325–328

[56] References Cited

U.S. PATENT DOCUMENTS

| | | | |
|---|---|---|---|
| 2,227,526 | 1/1941 | Wilson | 128/25 R |
| 2,749,911 | 6/1956 | Griffin | 128/70 |
| 2,784,591 | 3/1957 | Shoor | 272/73 |
| 3,057,201 | 10/1962 | Jaeger | 272/73 |
| 3,127,171 | 3/1964 | Noland et al. | 272/73 |
| 3,966,201 | 6/1976 | Mester | 272/73 |
| 4,372,551 | 2/1983 | Yurdin | 128/70 |

FOREIGN PATENT DOCUMENTS

| | | | |
|---|---|---|---|
| 1054204 | 4/1959 | Fed. Rep. of Germany . | |
| 1099918 | 2/1961 | Fed. Rep. of Germany | 272/73 |
| 7732247 | 1/1973 | Fed. Rep. of Germany . | |
| 964160 | 7/1964 | United Kingdom | 128/25 R |

OTHER PUBLICATIONS

Siemens Prospectus Data E242.

*Primary Examiner*—Richard J. Apley
*Assistant Examiner*—S. R. Crow
*Attorney, Agent, or Firm*—Wigman & Cohen

[57] ABSTRACT

An ergometer having an ergometer module with a braking device as well as two cranks as drive elements. The ergometer module is connected with the frame of a bench in a manner that allows a height and longitudinal adjustment of the ergometer module relative to the bench. The ergometer module is continuously pivotable by an electric motor driven self-locking adjustment drive for accommodating users of varying heights.

17 Claims, 2 Drawing Sheets

ERGOMETER

BACKGROUND OF THE INVENTION

The invention relates to an ergometer having an ergometer module having a braking device and two cranks as drive elements, which ergometer module is connected with the frame of a bench.

In a known ergometer of this type, the ergometer module is arranged at the foot end of the frame of the bench in a fixed position. The person being examined must therefore select his position on the bench so that he can activate the cranks provided as drive elements with his feet.

OBJECTS AND SUMMARY OF THE INVENTION

The object of the invention is to create an ergometer which can better be adapted to different requirements of the user. Other objects will become apparent from the description and drawings which follows.

Because of the adjustability of the ergometer module relative to the bench, it is possible in a simple manner to bring the ergometer module into an optimal position for the user. This is true not only for the case where the user assumes a reclining posture and activates the ergometer module with his legs. An adjustability of the ergometer module is equally as important when the user is in a seated position and when the cranks must be activated with the arms.

In a preferred embodiment the height adjustability of the ergometer module has a range of adjustment which permits a lowering of the ergometer module below the rest surface of the bench. The bench can then be used for examinations or the like without the ergometer module being in the way.

Preferably, the ergometer module is connected with the frame of the bench so as to be able to pivot about a cross-axis that is horizontal to the rest surface of the bench. This type of connection between the ergometer module and the frame of the bench is advantageous for more reasons than just its structural simplicity. It also makes possible a simultaneous height and longitudinal adjustment, which, as a rule, is advantageous for adjustment to an optimal position of the ergometer module.

In order for the user of the bench to assume a normal reclined position while activating the ergometer module, it is necessary to arrange the ergometer module for use above the foot rest area. However, in order to be able to lower the ergometer module beneath the rest surface of the bench, in a preferred embodiment an opening is provided in the rest surface to allow passage for the ergometer module. To assure that this opening is not disruptive when the ergometer module is in its lowered position, a cover plate is provided that is adapted to the contour of the opening and is advantageously upholstered in the same manner as the rest surface. It is simplest to remove this cover plate or replace it after the ergometer module has been lowered by hand. Of course, however, it would also be possible to attach this cover plate to the housing of the ergometer module, so that the opening is automatically closed upon the lowering of the ergometer module and is opened as the ergometer module is raised out of its lowered position.

In order to be able to adjust the ergometer module without difficulty, it is advantageous to provide a self-locking adjustment drive with at least one electric motor. If the ergometer module is pivotably mounted on the frame of the bench, it is not difficult to provide two electric motors for the adjustment, the torque of which is transferred to the ergometer module via a self-locking transmission, e.g., gearbox. This type of design of the adjustment drive makes it possible, using simple means, to hold the ergometer in the desired position with no play, even though the transmissions have a certain play. In the selected position, this play can be rendered ineffective by allowing the two electric motors to exert opposite torque forces on one or the other of the self-locking transmissions.

In addition, with a method of operation of the two electric motors such as this, it is possible in a simple manner to force a synchronous course during a position adjustment of the ergometer. To accomplish this, the two electric motors need only be coupled with each other by means of a rigid coupling device having, however, a limited play in the rotational direction. This play, which is necessary in order to be able to exert the opposite torques on the two transmissions in the selected position, can be kept so small that it is insignificant in the forced synchronous movement during the position change.

The invention is described in greater detail below with the aid of an exemplary embodiment illustrated in the drawings.

DETAILED DESCRIPTION OF THE PREFERRED EMBODIMENTS

Figure 1:
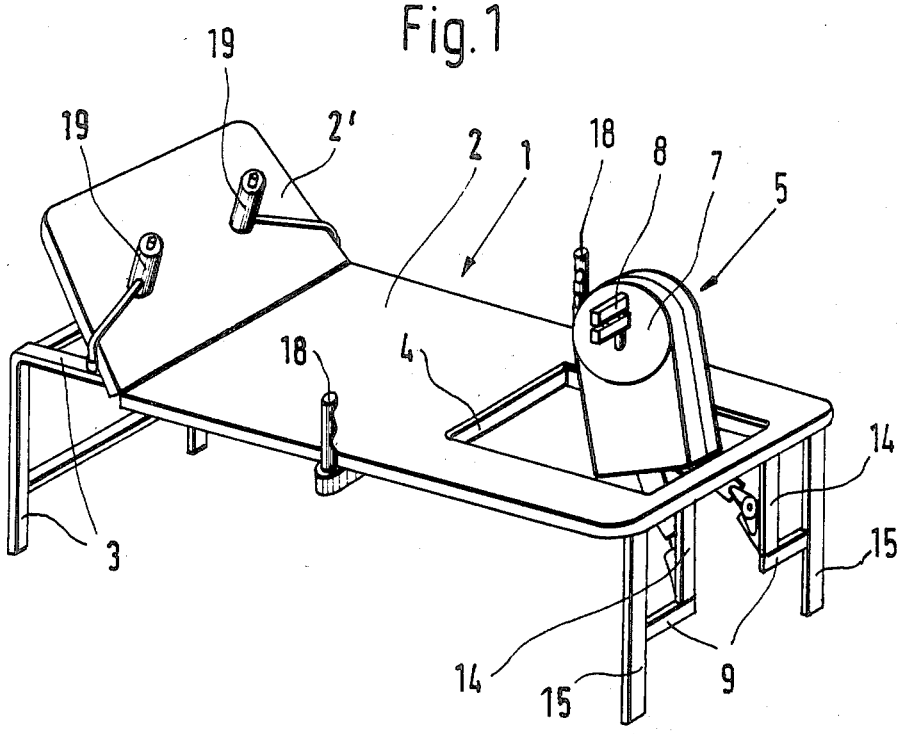
FIG. 1 is a perspective view of an exemplary embodiment of the present invention, shown in the operation-ready position.

A bench indicated generally at 1 has a rectangular bench upholstery 2, which is supported by a four-legged frame 3 in such a manner that the bench upholstery, with the exception of the section 2' serving to support the head and shoulders of a user, lies parallel to the support surface on which the bench rests. The section 2' can be pivoted upward about a lateral axis in a stepless manner, as shown in FIG. 1.

Figure 2:
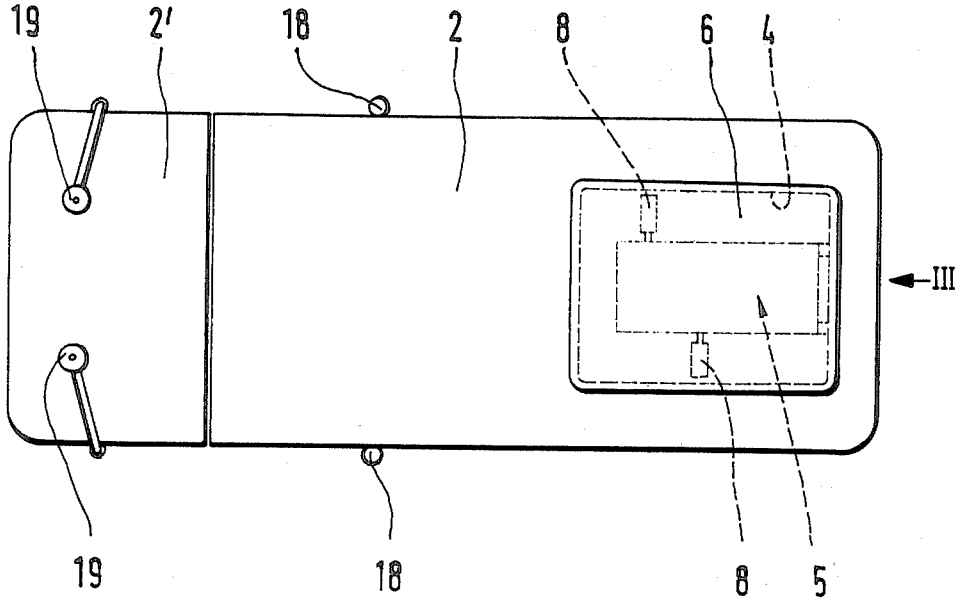
FIG. 2 is a top plan view of an exemplary embodiment of the present invention, shown in the lowered position of the ergometer module.

In the area serving to support the feet and lower legs, the bench upholstery 2 and a flat support for the bench upholstery (not shown) is provided with a rectangular opening 4, the width and length of which are selected in such a manner that an ergometer module, designated generally with numeral 5, which is pivotably connected with the frame 3 in the area of the foot end, can be moved through the opening 4. As shown in FIG. 2, the opening 4 can be fully closed by means of an upholstered cover plate 6, which engages in a surrounding groove in the upper edge of the opening 4 and is thereby secured against shifting in the longitudinal and lateral direction of the bench. This cover plate 6 lies flush with the edge areas of the bench upholstery 2 adjacent the opening and is therefore not disruptive or disturbing, for example, when the bench 1 is used for examination purposes. The cover plate 6, which in the exemplary embodiment is placed and removed manually, can, if necessary, for example if it has been damaged by the shoes of the bench user, be replaced with a new cover plate.

As shown in the drawings, the ergometer module 5 has, as compared to the width of the bench 1, a very narrow housing, which is rectangular in cross section and which is cylindrically curved at the end opposite the foot end of the frame 3. The curve radius of the curve is adapted to the curve radius of two circular discs 7, which are rigidly arranged together on the drive shaft of the ergometer module 5 and the outside edges of which are flush with the respective side surfaces of the housing. Each of the two discs 7 carries an outwardly projecting pin in diametric arrangement at the same distance from the drive shaft and parallel thereto, and a pedal or grip is rotatably mounted thereon. Accordingly, the discs 7, together with the pedals 8, form respective drive cranks.

An electrically controllable eddy current brake is arranged inside the housing of the ergometer module 5, the braking capacity of which can be adjusted in increments of a few watts within a range of 25 to 400 watts, and can be maintained independently of the drive rotational speed. The eddy current brake is driven by the drive shaft by means of a low-noise, double toothed belt drive.

Figure 3:
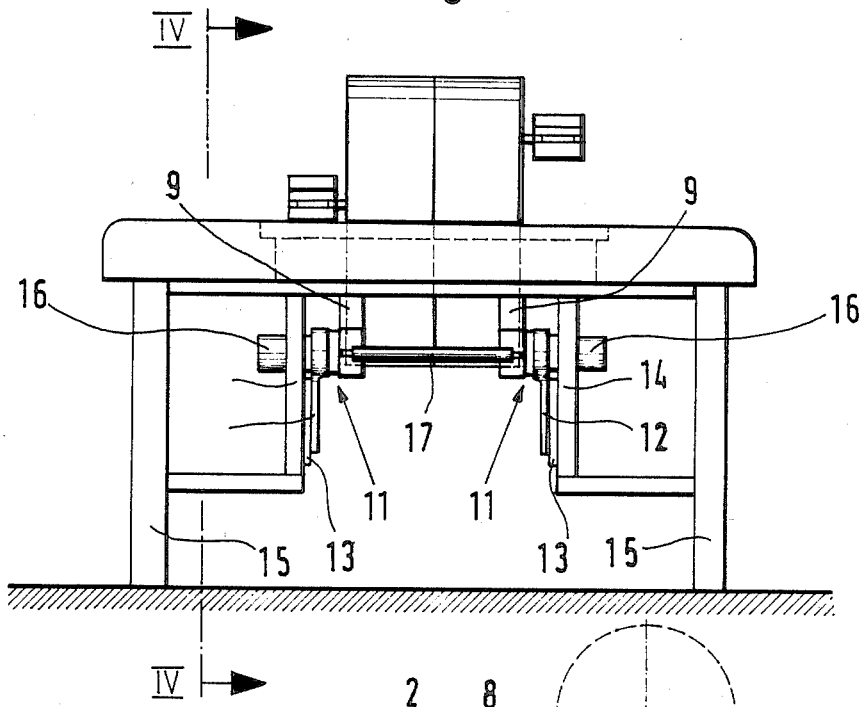
FIG. 3 is an end view of the foot end of the exemplary embodiment of FIG. 2 in the operation-ready position.
Figure 4:
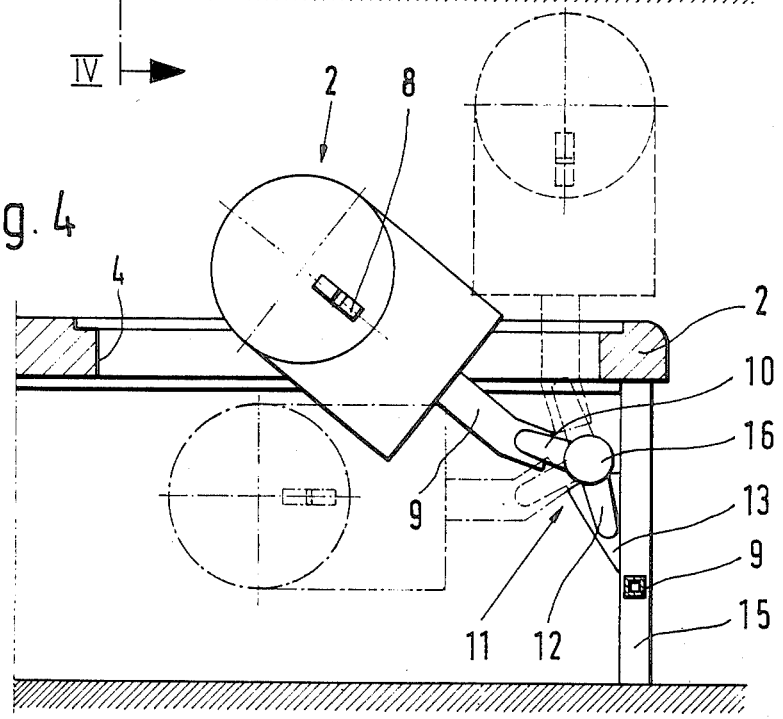
FIG. 4 is a sectional view according to the line IV—IV of FIG. 3, whereby the two end positions of the ergometer are shown.

As shown particularly by FIG. 4, the electronic module 5 is supported by two identical support means 9 projecting out of the narrow side of the housing facing the foot end of the frame 3, which support arms 9 are spaced from each other in the direction of the drive shaft and each of which is rigidly connected with one arm 10 of a hinge designated generally with numeral 11, the other arm 12 of which is rigidly connected with the frame 3. The hinge pins of the two identical hinges 11, which connect the arms 10 and 12 with each other in an articulated manner, are aligned with each other and define the lateral axis about which the ergometer module 5 can pivot relative to the frame 3. As shown by the FIGS. 3 and 4, this axis lies beneath the bench upholstery 2 near the foot end of the frame 3.

The two arms 10 and 12 of each hinge 11 are connected with each other by means of a self-locking gear transmission, whereby the drive shaft of this transmission is formed by the hinge pin. A rotation of the hinge pin thus leads to a pivoting movement of the arm 10 relative to the arm 12 and thereby to a corresponding pivoting movement of the ergometer module 5 about the pivot axis defined by the two hinge pins. The pivot range of the electric module 5 extends from a position illustrated in FIG. 4 with dot-dash lines, in which the ergometer module 5 is located beneath the bench upholstery 2, to a position illustrated with broken lines, in which the drive shaft of the ergometer module 5 is located above the pivot axis, and where the ergometer module thus stands upright and is easily accessible, for example, for a manual activation from the foot end of the bench, since it then has only a slight distance from the foot end of the bench in any event. The ergometer module 5 can be steplessly pivoted into any desired position between these two positions, whereby the opening 4 permits passage through the bench upholstery 2. Since during an adjustment of the ergometer module 5 the drive shaft moves along a circular path about the axis formed by the hinge pins, there is simultaneously a height adjustment and a longitudinal adjustment of the drive shaft and thereby also the pedals 8.

The arm 12 of each hinge 11 is attached to a respective plate 13, and each plate 13, in turn, is rigidly connected with two beams 14, which are arranged parallel to and between the two rear legs 15 of the frame 3, and the upper ends thereof are rigidly connected with a lateral support of the seat frame, while the lower ends thereof are rigidly connected with the neighboring leg by means of a connecting strap. The space between the two beams is so large that a person seated on a chair at the foot end of the bench, in order, for example, to be able to drive the discs 3 by hand, can place his legs between the beams 14.

An electric motor 16 is flanged to the arm 12 of each hinge 11 and is coupled with the hinge pin. In order to assure a synchronous mechanical movement of the two electric motors 16, the projecting end sections of the hinge pins are coupled with each other by a torsion resistant pipe 17. The connection between the pipe 17 and the two hinge pins, however, is formed in such a manner that a slight play is present in the rotational direction. This play does not limit the synchronous adjustment of the two arms 10, and yet permits that when the desired position of the ergometer module 5 is reached, the play present in the two transmissions that connect the arms 10 with the arms 12, is rendered ineffective, whereby the ergometer module 5 is locked into the selected position with no play. This is achieved by reversing the direction of rotation of one of the two electric motors 16 when the desired position of the ergometer module 5 is reached and having both electric motors remain engaged but running at a reduced current. As a result of the play in the coupling formed by the pipe 17, the two electric motors 16 load the two transmissions in opposite directions, which brings the result that the tooth gears of the transmission can be held in play-free contact with each other.

The control of the ergometer module 5 is performed by means of a cable from a data terminal, which has a keyboard for the input of the required values, including the desired braking performance as well as displays for input and output values. This data terminal also contains the electronics for the pulse control as well as for the control of the rotational speed range.

In order that the user lying on the bench upholstery 2 does not need to change his position as a result of the activation of the ergometer module 5, a hand grip 18 is arranged on each side of the bench and the positions thereof can be adjusted in the longitudinal direction of the bench. In addition, two upholstered, adjustable supports 19 project upward from the section 2' of the bench upholstery 2, which can be adjusted in such a manner that the user can support his shoulders thereon.

All characteristics mentioned in the above specification, as well as those that can only be obtained from the drawing, are included as additional embodiments of the invention, even if they are not especially emphasized and particularly not mentioned in the claims.

What I claim is:

1. The combination of a bench having a frame and an ergometer having a braking device as well as an ergometer module having two cranks as drive elements adapted for a user of said ergometer module, comprising:

means for connecting said ergometer module with the frame of said bench;

said connecting means having means for the height and longitudinal adjustment of the ergometer module relative to the bench, said connecting means being pivotable about a lateral axis lying horizontal to the rest surface of the bench; and said height and longitudinal adjustment means including an electric motor driven self-locking adjustment drive for the ergometer module;

said ergometer module being continuously pivotable about said lateral axis between a first position in which said ergometer module is located parallel to and beneath said bench and a second position in which said ergometer module stands perpendicularly upright above said bench;

wherein the longitudinal adjustment of the ergometer module continuously varies as the height of the ergometer module is adjusted;

whereby said ergometer module is adapted to accommodate users of varying heights.

2. The combination according to claim 1, wherein the lateral axis is arranged near the foot end of the bench beneath the rest surface and in that the ergometer module, in its lowered position, extends from the lateral axis toward the head end of the bench.

3. The combination according to claim 1, further including an opening in the rest surface of the bench for the passage of the ergometer module.

4. The combination according to claim 3, further including a removable cover plate that is adapted to the contour of the opening.

5. The combination according to claim 1, further including an opening in the rest surface of the bench for the passage of the ergometer module.

6. The combination according to claim 1, wherein the ergometer module is pivotably mounted on the frame of the bench, said adjustment drive has two electric motors, the torques of which can be transferred to pivot the ergometer module by means of respective transmissions.

7. The combination according to claim 6, wherein the two electric motors are oppositely directed torques in the selected pivot position of the ergometer module.

8. The combination according to claim 6, wherein the two electric motors are coupled with each other by means of a rigid coupling device which has a limited amount of play in the direction of rotation.

9. The combination according to claim 1, wherein said bench is an exercise bench.

10. The combination of a bench having a frame and an erogometer having a braking device as well as an ergometer module having two cranks as drive elements, comprising:

means for connecting said ergometer module with the frame of said bench;

said connecting means having means for the height and longitudinal adjustment of the ergometer module relative to the bench, said connecting means being pivotable about a lateral axis lying horizontal to the rest surface of the bench;

said height and longitudinal adjustment means including a self-locking adjustment drive for the ergometer module;

said self-locking adjustment drive comprising two electric motors adapted to rotate in the same direction for adjustment of the ergometer module and to rotate in opposite directions, remaining engaged, but running at a reduced current, to lock said ergometer module when said ergometer module reaches the desired adjustment position.

11. The combination according to claim 10, wherein said height adjustment means includes an adjustment range having a value that allows a lowering of the ergometer module beneath the rest surface of the bench.

12. The combination according to claim 11, wherein the lateral axis is arranged near the foot end of the bench beneath the rest surface and in that the ergometer module, in its lowered position, extends from the lateral axis toward the head end of the bench.

13. The combination according to claim 11, further including an opening in the rest surface of the bench for the passage of the ergometer module.

14. The combination according to claim 13, further including a removable cover plate that is adapted to the contour of the opening.

15. The combination according to claim 10, further including an opening in the rest surface of the bench for the passage of the ergometer module.

16. The combination according to claim 10, wherein the two electric motors are coupled with each other by means of a rigid coupling device which has a limited amount of play in the direction of rotation.

17. The combination according to claim 10, wherein said bench is an exercise bench.

* * * * *